US005356239A

United States Patent [19]

Canton

[11] Patent Number: 5,356,239

[45] Date of Patent: Oct. 18, 1994

[54] UNIVERSAL MODULAR PLATFORM METHOD AND APPARATUS

[75] Inventor: David W. Canton, Dhahran, Saudi Arabia

[73] Assignee: Saudi Arabian Oil Company, Dhahran

[21] Appl. No.: 117,875

[22] Filed: Sep. 7, 1993

Related U.S. Application Data

[63] Continuation of Ser. No. 822,474, Jan. 17, 1992, abandoned.

[51] Int. Cl.[5] ..... E02B 17/02

[52] U.S. Cl. ..... 405/227; 405/204

[58] Field of Search ..... 405/195.1, 203, 204, 405/224, 224.2, 225, 227

[56] References Cited

U.S. PATENT DOCUMENTS

| | | | |
|---|---|---|---|
| 2,574,140 | 11/1951 | Boschen | 405/204 |
| 2,598,329 | 5/1952 | Wilson | 405/204 |
| 3,115,013 | 12/1963 | Thornley | 405/227 X |
| 4,070,869 | 1/1978 | Williams | 405/227 X |
| 4,161,376 | 7/1979 | Armstrong | 405/196 |
| 4,295,317 | 10/1981 | VanTielen | 52/637 |
| 4,492,270 | 1/1985 | Horton | 166/358 |
| 4,511,288 | 4/1985 | Wetmore | 405/217 |
| 4,812,080 | 3/1989 | Urquhart et al. | 405/204 X |
| 4,813,815 | 3/1989 | McGehee | 405/202 |
| 4,867,611 | 9/1989 | Luyties | 405/204 X |
| 4,917,541 | 4/1990 | Carruba | 405/204 X |
| 4,958,960 | 9/1990 | Turner et al. | 405/195 |

*Primary Examiner*—David H. Corbin

*Attorney, Agent, or Firm*—Davis Hoxie Faithfull & Hapgood

[57] ABSTRACT

Disclosed is a modular offshore platform for use in water depths of 160 feet and less. The jacket assembly of the structure is composed of interchangeable stackable modular units. The horizontal cross section of the jacket assembly has a truncated triangular configuration. Some of the vertical members of modules of the jacket assembly are adapted to allow the passage of piles which function as conductors and some of the vertical members are adapted to allow the passage of piles only. The jacket assembly is designed to lie well beneath the water surface so that it is not subject to great wave forces and does not need to be battered.

19 Claims, 7 Drawing Sheets

UNIVERSAL MODULAR PLATFORM METHOD AND APPARATUS

"This is a continuation of copending application Ser. No, 07/822,474 filed on Jan. 17, 1992, now abandoned"

FIELD OF THE INVENTION present invention relates to the field of offshore drilling platforms, and more particularly to a more efficient jacket assembly design for an offshore drilling platform.

BACKGROUND OF THE INVENTION

Offshore platforms are expensive to manufacture. Often they have to be developed with a particular region and water depth in mind. In addition, the platforms are often large and difficult to transport or construct. Thus, there is a great need for more efficient designs and methods of construction. Certain prior art platforms employ stackable modules in the support structure for the platform. Wetmore, U.S. Pat. No. 4,511,288, for example, discloses stackable modules, however these modules are heavy, walled, and dense structures, weighing thousands of pounds, and they are not interchangeable. Moreover, the modules in Wetmore do not make up a jacket assembly. A jacket assembly, as the term is used in this patent means a skeletal structure, designed for supporting an offshore platform, which is comprised of a plurality of rigid members which are joined together.

Horton, U.S. Pat. No. 4,492,270 discloses a well jacket assembly with standardized nodes and cross members but does not disclose stackable, interchangeable modules. Turner et al., U.S. Pat. No. 4,958,960 discloses a "modular" structure however there is no indication that the "module" is constructed with stackable interchangeable modules. In addition the "modular" structure is structurally separate from the jacket assembly.

In the prior art a support structure frequently used for the platform was a jacket assembly, consisting of six substantially vertical legs, as in the case of Turner et al., U.S. Pat. No. 4,958,960. The horizontal cross section of such a jacket assembly is rectangularly shaped. Armstong, U.S. Pat. No. 4,161,376, however, discloses a triangular cross section in which only three legs are used, and Horton U.S. Pat. No. 4,492,270 discloses the use of three jackup legs (see FIG. 1).

In the prior art, conductors for transporting fluid were usually structurally separate from the supporting elements of the platform. Armstong, U.S. Pat. No. 4,161,376 discloses that leg 12 can be provided with conductors to allow anchoring and drilling therethrough. However, Armstong is not directed to a modular construction for a jacket assembly. McGehee U.S. Pat. No. 4,813,815 discloses that fluid can be transported through a joint, however, McGehee is not directed to a jacket assembly but rather a single rotatable bouyant column.

In the prior art, jacket assemblies were constructed so that at least some of the jacket assembly was above the water surface. See Wetmore, U.S. Pat. No. 4,511,288, FIG. 1; Horton, U.S. Pat. No. 4,492,270, FIG. 1; Armstong, U.S. Pat. No. 4,161,376, FIG. 7; although McGehee U.S. Pat. No. 4,813,815 states that the platform can be in or above the water, it is directed toward a buoyant rotable column, and not a jacket assembly as noted above.

OBJECTS AND SUMMARY OF THE INVENTION

It is an object of the present invention to overcome the shortcomings of the prior art jacket assembly designs for offshore drilling platforms.

It is a further object of the invention to provide a method for manufacturing offshore platforms so that they need not be developed with a particular region and/or water depth in mind.

It is a further object of the invention to provide an efficient design for an offshore platform.

It is a further object of the invention to provide for a modular offshore platform constructed by a modular technique.

It is a further object of the invention to provide for a jacket assembly design for an offshore platform which has a truncated triangular horizontal cross section, having a major side at its base and a minor side at the truncation.

It is further object of the invention to provide for a modular jacket assembly design having substantially vertical members which allow the passage of piles which also function as conductors.

It is further object of the invention to provide an offshore platform for use in waters of 160 feet or less.

It is further object of the invention to provide an offshore platform whose jacket assembly lies beneath the water surface.

It is further object of the invention to provide an offshore platform which reduces costs over the prior art.

In accordance with a first aspect of the invention a method and apparatus for a modular jacket assembly for an offshore platform, comprises the use of stackable modules.

In accordance with a second aspect of the invention a method and apparatus for a modular Jacket assembly for an offshore platform, comprises the use of interchangeable stackable modules.

In accordance with a third aspect of the invention a jacket assembly for an offshore platform is provided with a truncated triangular horizontal cross section, having a major side at its base and a minor side at the truncation.

In accordance with a fourth aspect of the invention, substantially vertical members of the jacket assembly allow the passage of at least one pile which also functions as a conductor, wherein said piles are structurally connected to the jacket assembly.

In accordance with a still further aspect of the invention the jacket assembly is designed to lie beneath the water surface.

The present invention greatly simplifies the construction and reduces the cost of offshore platforms for use in depths of 160 feet or less by providing for an offshore platform jacket assembly design and construction method which comprises (1) a simple modular construction technique (2) a truncated triangular cross section, (3) members which allow the passage of piles which also function as conductors, and (4) a jacket assembly height which is beneath the water surface.

The modular technique disclosed by the present invention comprises the use of interchangeable stackable modules in the jacket assembly design. Interchangeability simplifies and standardizes platform design, fabrication, and construction and reduces costs. In an exemplary embodiment, the present invention comprises only four piles/legs and its horizontal cross section is a truncated triangle. The truncated triangular configuration of the present invention provides greater support than the triangular configuration but is less costly then the rectangular configuration. The present invention, in its preferred embodiment, provides for connecting two piles which also function as conductors to a modular jacket assembly.

The preferred embodiment of the present invention reduces steel costs by 40% over the typical design in the prior art. (six piles, six conductors, rectangular shape). The preferred embodiment of the present invention has two piles that do not function as conductors, two piles that function as conductors, and four conductors that do not function as piles. In addition, no "battering" is needed and there is a reduction in height requirements because the jacket assembly lies beneath the water surface.

BRIEF DESCRIPTION OF THE DRAWINGS

These and other objects, aspects, and embodiments of the present invention will be described with reference to the following drawing figures, of which.

DETAILED DESCRIPTION OF THE DRAWINGS

The present invention will be described with reference to FIGS. 1A & 1B but it will be appreciated that other offshore platforms may be constructed by a greater number or a lesser number of modules, or by constructing these modules differently, or by combining these modules differently. Any dimensions given are exemplary and other dimensions and sizes can be employed, as will be appreciated by those skilled in the art.

Figure 1A:
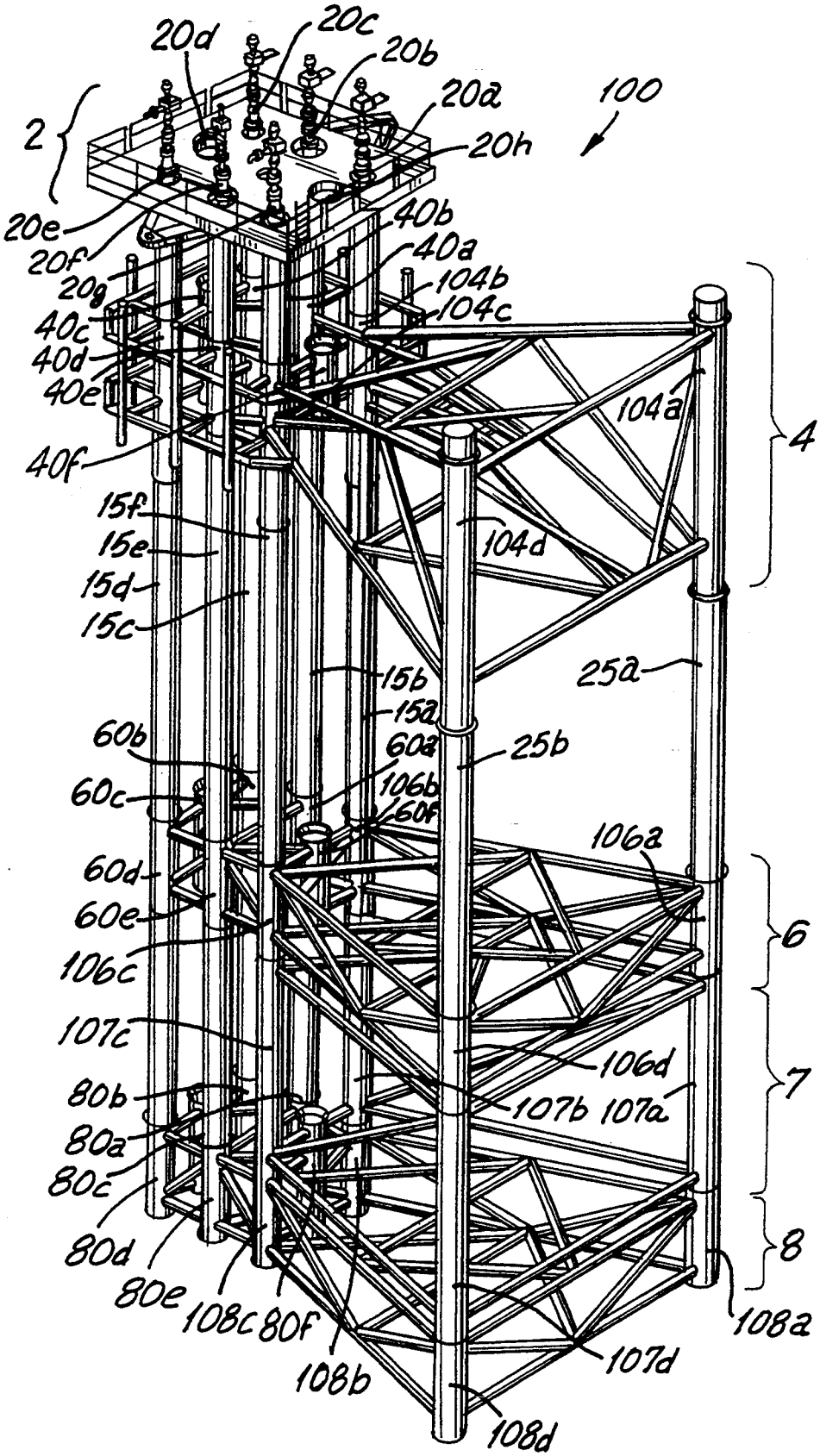
FIG. 1A is a perspective view of an example of an offshore drilling platform according to the present invention.
Figure 1B:
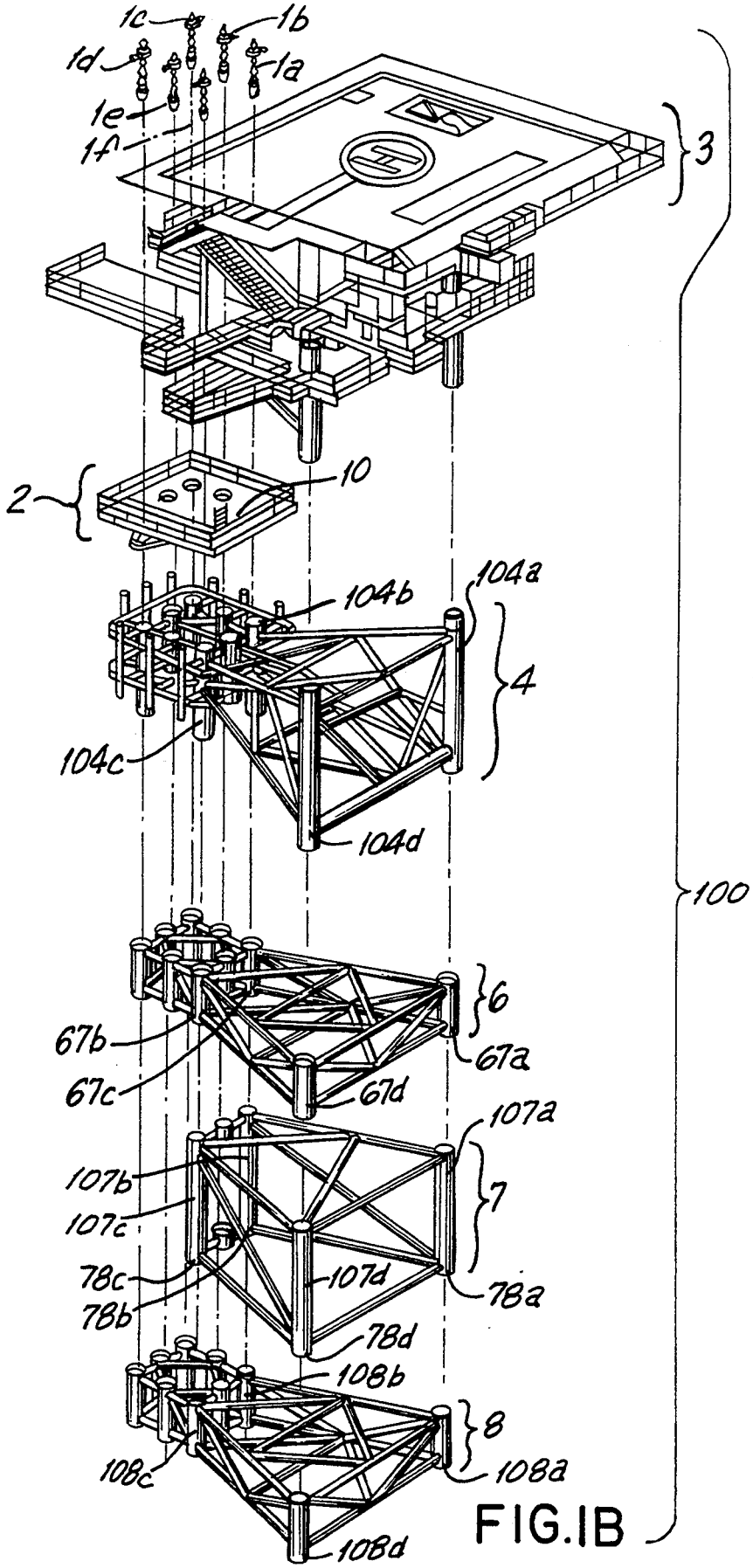
FIG. 1B is a perspective view of the separate modules of FIG. 1A.

Both FIG. 1A and FIG. 1B refer to a configuration for 65 to 95 foot water depths. This configuration utilizes the two basic modular units disclosed by this invention. Specifically, two 12 ft. modular units and one 28 ft. modular unit are used in this configuration. FIG. 1A is a perspective view of a universal modular platform 100 as an integrated whole, in accordance with the present invention. FIG. 1B shows the various modules of platform 100.

Referring to FIG. 1A, a first 12 ft. modular unit, 8, is shown at the base of the platform 100. Stacked on top of the 12 ft. modular unit 8, is 28 ft. modular unit 7. Modular unit 7 and modular unit 8 are welded together at vertices 78*a*, 78*b*, 78*c* and 78*d* shown on FIG. 1B. Stacked on top of the modular unit 7, is second 12 ft. modular unit, 6. Modular unit 6 and modular unit 7 are welded together at vertices 67*a*, 67*b*, 67*c* and 67*d*, which are shown on FIG. 1B. Modular units 6, 7 and 8 together form the jacket assembly.

Referring to FIG. 1A, pile/conductors 15*a* and 15*f* are piles which also function as conductors of fluids or gasses. In the present embodiment the pile/conductors 15*a* and 15*f* shown are 36" in diameter. Piles 25*a* and 25*b* on the other hand do not function as conductors. The piles 25*a* and 25*b* are 42" in diameter. It is preferable that the piles 25*a* and 25*b* be larger than the pile/conductors 15*a* and 15*f*, as the jacket assembly is oriented so that the environmental loads (wind, wave, and ocean currents) impose much greater forces on these piles than on the pile/conductors. Both the piles and the pile/conductors have a 1" wall thickness. The piles and the pile/conductors are driven through the hollow vertical members of the jacket assembly and into the seabed as shown. Pile/conductor 15*a* passes through the hollow vertical member 106*b* in 12 ft. modular unit 6, hollow vertical member 107*b* in 28 ft. modular unit 7, and hollow vertical member 108*b* in 12 ft. modular unit 8 and into the seabed. Pile/conductor 15*f* and piles 25*a* and 25*b* pass through the appropriate hollow vertical members in the jacket assembly and into the seabed in a similar manner.

After the pile/conductors 15*a* and 15*f* and the piles 25*a* and 25*b* are driven into the seabed, the space inside the hollow vertical members between the piles or pile/-conductors and the hollow vertical men%bets is filled with grout. In this manner the piles and the pile/conductor become structurally connected to the jacket assembly.

The hollow vertical members 104*b* and 104*c* of the brace and support structure 4 pass over the pile/conductors 15*a* and 15*f* and the hollow vertical members 104*a* and 104*d* pass over piles 25*a* and 25*b*. "Stops" are welded on the piles and pile/conductors so that the brace and support structure is supported while it is welded in place. After welding, brace and support structure 4 is grouted to the piles 25*a* and 25*b* and to the pile/conductors 15*a* and 15*f* in the same manner that the jacket assembly was grouted to the piles and pile/conductors.

The drilling deck 2 is also welded to the piles and pile/conductors. The main deck 3, or production deck, shown on FIG. 1B, is installed after the wells are drilled and is welded to the two piles 25*a* and 25*b* and rests on two pins that cantilever out from the drilling deck.

The conductors 15*b–e* are driven through the appropriate hollow vertical members of the jacket assembly. As shown in FIG. 1A, conductor 15*b* passes through drilling deck hole 20*b*, brace and support structure hollow vertical members 40*a*, hollow vertical member 60*a* of 12 ft. modular unit 6, and hollow vertical member 80*a* of 12 ft. modular unit 8. The other conductors also pass through the appropriate hollow vertical members. The conductors are not grouted to the hollow vertical members as the piles and pile/conductors are and thus do not provide structural support for the jacket assembly. Stacked on the top of conductors 15*a–f*, are wellheads 1*a–f*, as shown in FIG. 1B. The wellheads 1*a–f* protrude from the top of the drilling deck 2.

Also shown in FIG. 1B, within drilling deck 2, is ladder access 10.

The procedure for installing an offshore platform of the present invention will now be described. Before being brought to the drilling site, the 12 ft. modular unit 8, the 28 ft. modular unit 7, and the 12 ft. modular unit 6 are welded together into a jacket assembly. At the site, the jacket assembly is lowered to the sea bed. After the jacket assembly is lowered the two piles 25*a* and 25*b* and the two piles/conductors 15*a* and 15*f* are lowered through the jacket assembly and driven into the seabed. The piles and pile/conductors are then grouted to the hollow vertical members of the jacket assembly. The brace and support structure 4 is welded and grouted to the piles and pile/conductors at the water line. The four remaining conductors 15*b–e* are then driven into the seabed. The drilling deck 2 is then installed on the conductors.

The 12 foot modular units now will be described in detail with reference to FIGS. 2A–E. Although reference is made only to modular unit 8, the description is equally applicable to modular unit 6 when the appropriate elements of modular unit 6 are substituted for the corresponding elements of modular unit 8.

Figure 2A:
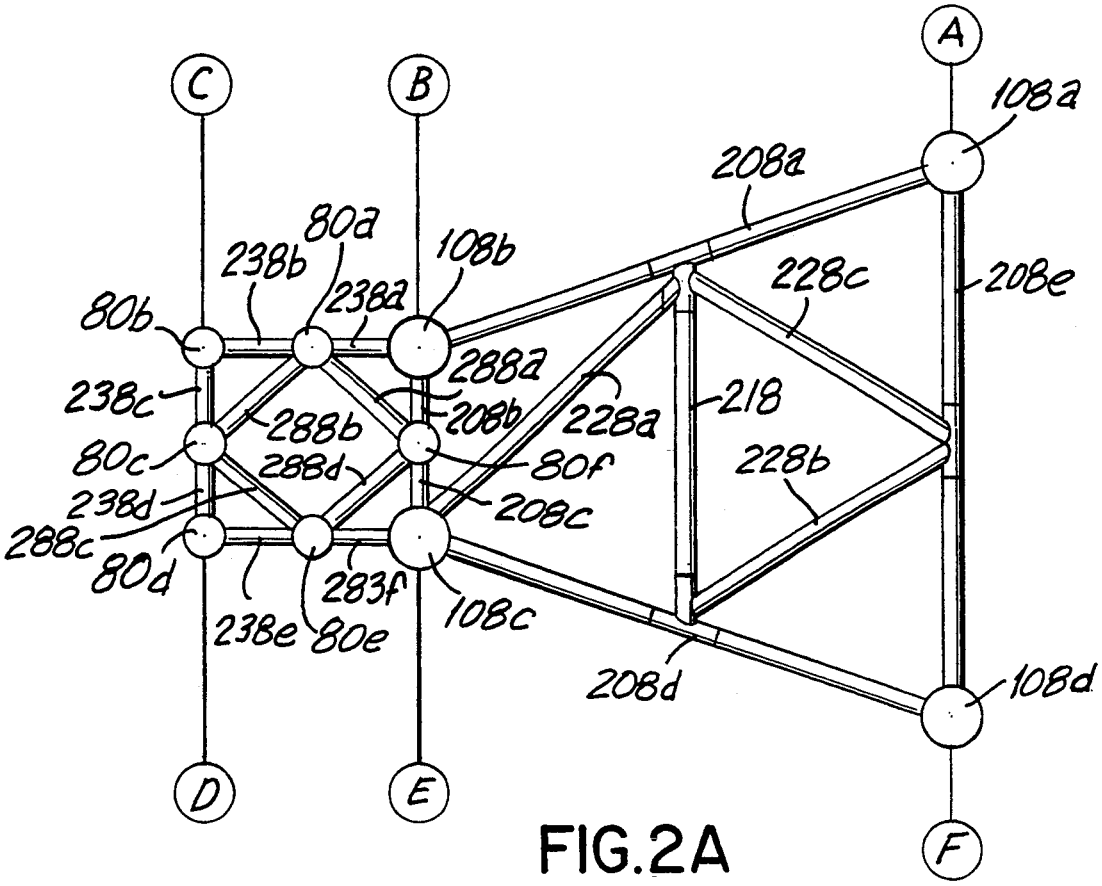
FIGS. 2A–E, are plans and elevations at various sections of framing of the 12 ft. modular unit 8 shown in FIGS. 1A and 1B.

FIG. 2A shows the top horizontal framing of 12 ft. modular unit 8. The vertices ABEF delineate a truncated triangular shape, having a major side AF and a minor side BE. The vertices BCDE delineate a rectangular configuration. Vertices A and F denote the tops of hollow vertical members 108*a* and 108*d* through which piles 25*a* and 25*b* are driven. In the example described, hollow vertical members 108*a* and 108*d* are 48 inches in diameter. The walls of hollow vertical members 108*a* and 108*d* are 1.75 inches in thickness. The permissible diameters of hollow vertical members 108*a* and 108*d* are dependent upon the diameters of piles 25*a* and 25*b*.

Vertices B and E are the tops of hollow vertical members 108*b* and 108*c* through which pile/conductors 15*a* and 15*f* are driven. The diameters of hollow vertical members 108*b* and 108*c* are dependent upon the diameters of pile/conductors 15*a* and 15*f* respectively. In the example shown, for a pile/conductor diameter of 36 inches a suitable diameter for hollow vertical members 108*b* and 108*c* is 42 inches. The walls of hollow vertical members 108*b* and 108*c* are 1.75 inches thick.

Vertices C and D are the tops of hollow vertical members 80*b* and 80*d* through which conductors 15*c* and 15*d* are driven. The diameters of hollow vertical members 80*b* and 80*d* are dependent upon the diameters of conductors 15*c* and 15*d* respectively. In the example shown, for a conductor diameter of 32 inches a suitable diameter for hollow vertical members 80*b* and 80*d* is 36 inches. The walls of hollow vertical members 80*b* and 80*d* are 1 inch thick.

Located on the perimeter of truncated triangular configuration ABEF are perimeter members 208*a–e*. Perimeter members 208*a* and 208*d–e* are welded at one end to a hollow vertical member through which a pile or pile/conductor is driven and at the other end to a hollow vertical member through which another pile or pile/conductor is driven. Along side BE of the truncated triangular, perimeter member 208*b* and 208*c* are each welded to hollow vertical member 80*f* on one end and to hollow vertical member 108*b* and 108*c* respectively at the other end.

Center member 218 is welded at one end to the center of perimeter member 208*a*, and at its other end is welded to the center of perimeter member 208*d*. Diagonal member 228*a* is welded at one end near the top of center member 218 and at its other end to hollow vertical member 108*c*. Diagonal member 228*b* is welded at one end near the bottom of center member 218 and at its other end near the center of perimeter member 208*e*. Diagonal member 228*c* is welded at one end near the top of center member 218, and at its other end near the center of perimeter member 208*e*.

Perimeter member 238*a* is welded at one end to hollow vertical member 108*b* and at its other end to hollow vertical member 80*a*. Perimeter member 238*b* is welded at one end to hollow vertical member 80*a* and at its other end to hollow vertical member 80*b*. Perimeter member 238*c* is welded at one end to hollow vertical member 80*b* and at its other end to hollow vertical member 80*c*. Perimeter member 238*d* is welded at one end to hollow vertical member 80*c* and at its other end to hollow vertical member 80*d*. Perimeter member 238*e* is welded at one end to hollow vertical member 80*d* and at its other end to hollow vertical member 80*e*. Perimeter member 238*f* is welded at one end to hollow vertical member 80*e* and at its other end to hollow vertical member 108*c*.

Diagonal member 288*a* is welded at one end to hollow vertical member 80*f*, and at its other end to hollow vertical member 80*a*. Diagonal member 288*b* is welded at one end to hollow vertical member 80*a*, and at its other end to hollow vertical member 80*c*. Diagonal member 288*c* is welded at one end to hollow vertical member 80*c*, and at its other end to hollow vertical member 80*e*. Diagonal member 288*d* is welded at one end to hollow vertical member 80*e*, and at its other end to hollow vertical member 80*f*.

Members 208*a–e*, 228*a–c*, 218, and 238*a–f* may all be of the same diameter and 14 inches is an appropriate diameter. Members 238*a–b*, 238*e–f*, and 228*a–c* may all be of the same thickness and 0.375 inches is an appropriate thickness. It is preferred that members 208*a* and 208*d* be composed of two thicknesses, and a thickness of 0.625 inches near the center of the member and 0.5 inches elsewhere is appropriate. Members 238*c–d*, 208*b*, and 208*c* may all be composed of the same thickness and 0.875 inches is an appropriate thickness. It is preferred that member 208*e* be composed of two thicknesses, and a thickness of 0.5 inches near the center of the member and 0.375 inches elsewhere is appropriate. It is preferred that hollow vertical members 80*a*, 80*e*, and 80*f* be of the same diameter and thickness and 36 inches and 1 inch, respectively, are appropriate measurements. It is preferred that hollow vertical member 80*c* be of a slightly larger diameter than 80*a*, 80*e* and 80*f* but of the same thickness and 40 inches and1 inch, respectively, are appropriate measurements.

The horizontal bottom framing for modular unit 8 is the same as the horizontal top framing.

Figure 2B:
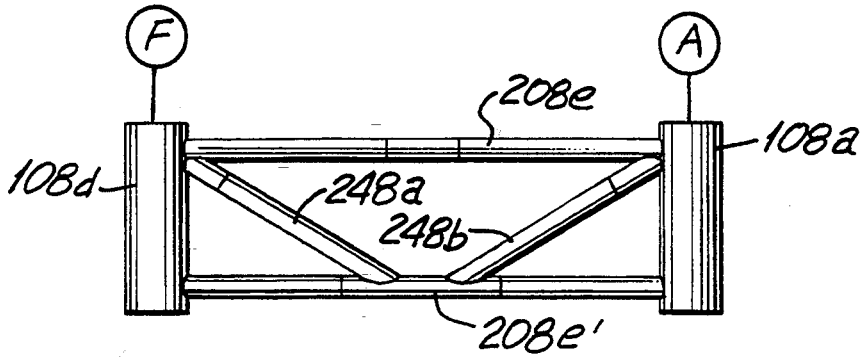

FIG. 2B shows the vertical framing of the 12 ft. modular unit 8 along row FA. Top perimeter member 208*e* is shown welded to hollow vertical members 108*a* and 108*d*. Bottom perimeter member 208*e'* is also shown welded to piles 108*a* and 108*d*. Diagonal members 248*a* and 248*b* are welded at one end near the center of the bottom perimeter member 208*e'* and at their other ends near the top of hollow vertical members 108*a* and 108*d*, respectively. It is preferred that members 248*a* and 248*b* be of two thicknesses, and 0.75 inches near the top of the member, and 0.375 inches elswhere is appropriate. It is preferred that members 248*a* and 248*b* be the same diameter, and 14 inches is an appropriate diameter.

The vertical framing of the 12 ft. modular unit 8 along row AB and along row EF is the same as along row FA with the exception that the hollow vertical members through which the pile/conductors pass 108*b* and 108*c*, are of different dimensions than the hollow vertical members through which the piles run through.

Figure 2C:
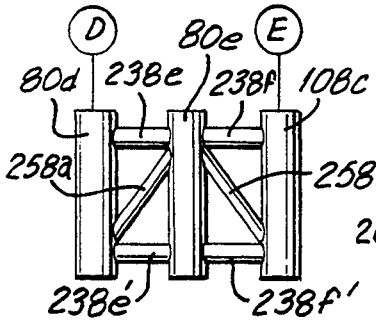

FIG. 2C shows the vertical framing along row DE. Top perimeter member 238*e* is welded at one end to hollow vertical member 80*d*, and at its other end to hollow vertical member 80*e*. Top perimeter member 238*f* is welded at one end to hollow vertical member 80*e*, and at its other end to hollow vertical member 108*c*. Bottom perimeter members 238*e'* and 238*f'* are welded like their top counterparts. Diagonal member 258*a* is welded at one end near the top of hollow vertical member 80*e*, and at its other end near the bottom of hollow vertical member 80*d*. Diagonal member 258*b* is welded at one end near the top of hollow vertical member 80*e*, and at its other end near the bottom of hollow vertical member 108*c*. Members 258*a–b* may be of the same diameter and thickness and 14 inches and 0.375 inches respectively, are appropriate measurements.

The vertical framing along row BC is the same as the vertical framing along row DE.

Figure 2D:
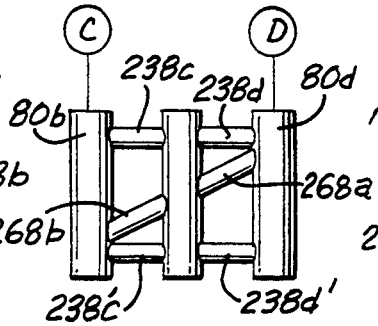

FIG. 2D shows the vertical framing along row CD. Perimeter member 238*c* is welded at one end to hollow vertical member 80*b* and at its other end to hollow vertical member 80*c*. Perimeter member 238*d* is welded at one end to hollow vertical member and at its other end to hollow vertical member 80*d*. Perimeter members 238*c'* and 238*d'* are welded in a like manner. Diagonal member 268*a* is welded at one end to the center of hollow vertical member 80*c*, and at its other end near the top of hollow vertical member 80*d*. Diagonal member 268*b* is welded at one end to the center of hollow vertical member 80*c*, and at its other end near the bottom of hollow vertical member 80*b*. Members 268*a–b* may be of the same diameter and thickness and 14 inches and 0.875 inches respectively are appropriate measurements.

Figure 2E:
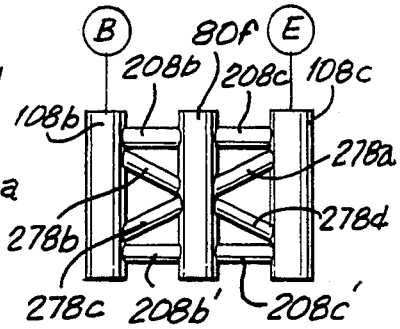

FIG. 2E shows the vertical framing along row BE. Perimeter member 208*b* is welded at one end to hollow vertical member 108*b* and at its other end to hollow vertical member 80*f*. Perimeter member 208*c* is welded at one end to hollow vertical member 108*c* and at its other end to hollow vertical member 80*f*. Perimeter members 208*b'* and 208*c'* are welded in a like manner at the bottom of the framing. Diagonal member 278*a* is welded at one end near the middle of hollow vertical member 80*f* and at its other end near the top of hollow vertical member 108*c*. Diagonal member 278*b* is welded at one end near the middle of hollow vertical member 80*f* and at its other end near the top of hollow vertical member 108*b*. Diagonal member 278*c* is welded at one end near the middle of hollow vertical member 80*f* and at its other end near the bottom of hollow vertical member 108*b*. Diagonal member 278*d* is welded at one end to the middle of hollow vertical member 80*f* and at its other end near the bottom of hollow vertical member 108*c*. Members 278*a–d* may be of the same diameter and thickness and 14 inches and 0.875 inches respectively are appropriate measurements.

The above module may be of a size other than 12 ft. The members of the module may be welded and constructed in other ways without departing from the spirit of the present invention, as will be recognized by those skilled in the art.

The 28 foot modular unit will now be described in detail with reference to FIGS. 3A–E.

Figure 3A:
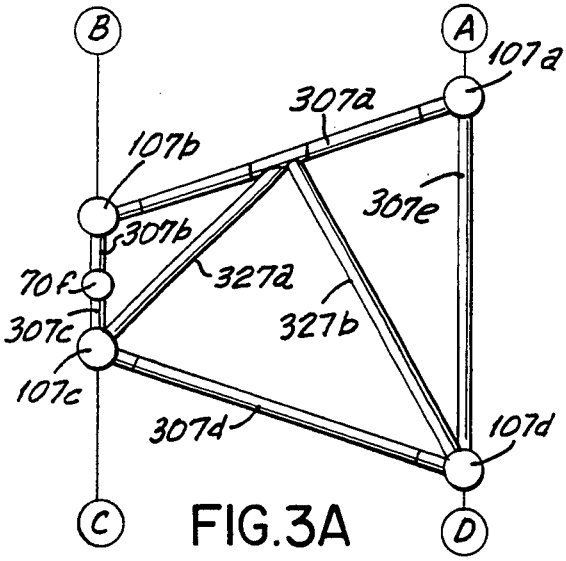
FIGS. 3A–D are plans and elevations at various sections of framing of the 28 ft. modular unit 7 shown in FIGS. 1A and 1B.

FIG. 3A shows the top horizontal framing of 28 ft. modular unit 7. The vertices ABCD delineate a truncated triangular shape, with vertical side AD and minor side BC. Vertices A and D denote the tops of hollow vertical members 107*a* and 107*d* through which piles 25*a* and 25*b* are driven. Hollow vertical members 107*a* and 107*d* are 48 inches in diameter like hollow vertical members 108*a* and 108*d* of 12 ft. modular unit 8. The walls of hollow vertical members 107*a* and 107*d*, unlike the walls of hollow vertical members 108*a* and 108*d*, have two different thicknesses. The walls of 107*a* and 107*d* are 1.75 inches thick near the top and bottom of the hollow vertical members and 0.5 inches thick near the middle of the hollow vertical members. The greater thickness is provided at areas where welding connections are made in order to increase the ability of the welded connection to resist failure due to fatigue phenomena caused by cyclic loading by wave forces during the 15-year design life. The two thicknesses provide stability and optimize steel costs. The permissible diameters of hollow vertical members 107*a* and 107*d* are dependent upon the diameters of piles 25*a* and 25*b*, respectively.

Vertices B and C are the tops of hollow vertical members 107*b* and 107*c* through which pile/conductors 15*a* and 15*f* are driven. The diameters of hollow vertical members 107*b* and 107*c* are dependent upon the diameters of pile/conductors 15*a* and 15*f* respectively. For a pile/conductor diameter of 36 inches a suitable diameter for hollow vertical members 107*b* and 107*c* is 42 inches. Unlike modular unit 8, the walls of hollow vertical members 107*b* and 107*c* are of two thicknesses. Near the top and bottom the hollow vertical members are 1.75 inches thick and near the middle the hollow vertical members are 0.5 inches thick.

Perimeter member 307*a* is welded at one end to hollow vertical member 107*b* and at its other end to hollow vertical member 107*a*. Perimeter member 307*b* is welded at one end to hollow vertical member 107*b* and at its other end to hollow vertical member 70*f*. Perimeter member 307*c* is welded at one end to hollow vertical member 107*c* and at its other end to hollow vertical member 70*f*. Perimeter member 307*d* is welded at one end to hollow vertical member 107*c* and at its other end to hollow vertical member 107*d*. Perimeter member 307*e* is welded at one end to hollow vertical member 107*d* and at its other end to hollow vertical member 107*a*.

Diagonal member 327*a* is welded at one end near the middle of perimeter member 307*a*, and at its other end to hollow vertical member 107*c*. Diagonal member 327*b* is welded at one end near the middle of perimeter member 307*a*, and at its other end to hollow vertical member 107*d*.

The members 307*a–e* and 327*a–b* may all be of the same diameter and an appropriate diameter is 14 inches. It is preferred that members 327*a–b* and 307*b–c* be of the same thickness and an appropriate thickness is 0.375 inches. It is preferred that 307*a* and 307*d* each be composed of two thicknesses. Members 307*a* and 307*d* are 0.5 inches thick in areas where there is no welding connection and 0.75 inches thick in areas where there is a welding connection. It is preferred that member 307*e* be of a uniform 0.5 inch thickness.

Figure 3C:
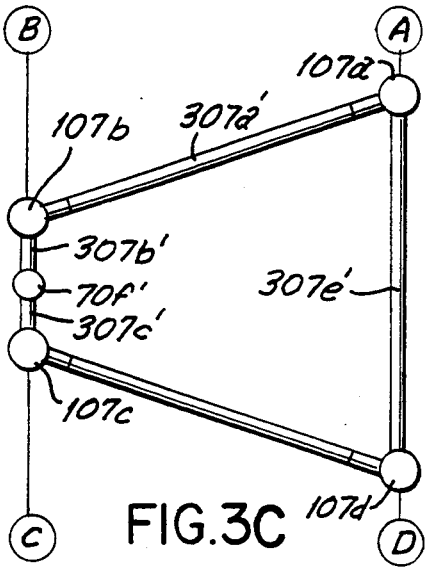
Figure 3B:
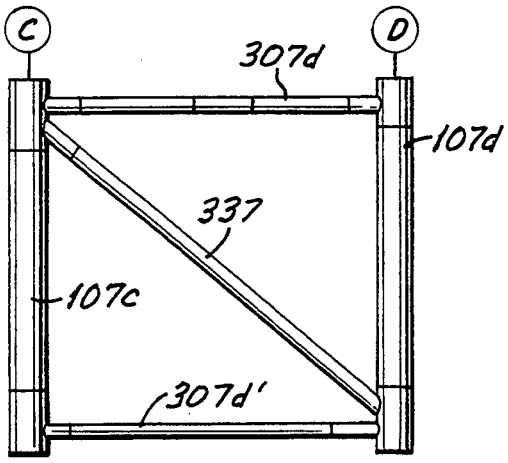

FIG. 3B is a plan of the vertical framing of 28 ft. modular unit 7 along row CD. Perimeter member 307*d* is welded at one end to hollow vertical member 107*c* and at its other end to hollow vertical member 107*d*. Perimeter member 307*d'* is welded in a like manner at the bottom of the framing. Diagonal member 337 is welded at one end near the top of hollow vertical member 107*c* and at its other end near the bottom of hollow vertical member 107*d*.

It is preferred that diagonal member 337 be composed of a diameter which is greater than other members and 16 inches is an appropriate diameter. It is also preferred that diagonal member 337 be thicker in welding areas than in non-welding areas and 1.125 and 0.5 inches are appropriate thicknesses.

The plan of the vertical framing along row AB is opposite that of the vertical framing along row CD. The vertical framing along row DA is exactly the same as the vertical framing along row CD except that the hollow vertical members through which piles pass are of a larger diameter and thickness, than the hollow vertical members through which piles/conductors pass.

FIG. 3C is a plan of the bottom horizontal framing of 28 ft. modular unit 7. Perimeter member 307*a'* is welded at one end to hollow vertical member 107*b* and at its other end to hollow vertical member 107*a*. Perimeter member 307*b'* is welded at one end to hollow vertical member 107*b* and at its other end to hollow vertical member 70*f'*. Perimeter member 307*c'* is welded at one end to hollow vertical member 107*c* and at its other end to hollow vertical member 70*f'*. Perimeter member 307*d'* is welded at one end to hollow vertical member 107*c* and at its other end to hollow vertical member 107*d*. Perimeter member 307*e'* is welded at one end to hollow vertical member 107*d* and at its other end to hollow vertical member 107*a*.

It is preferred that members 307*a'*–307*e'* all be of the same diameter and 14 inches is an appropriate diameter. It is preferred that members 307*b'*, 307*c'*, and 307*e'* be of the same thickness and 0.375 inches is an appropriate thickness. It is preferred that members 307*a'* and 307*d'* be composed of two thicknesses and 0.5 inch thicknesses at welding locations and 0.375 inches at non welding locations are appropriate thicknesses.

Figure 3D:
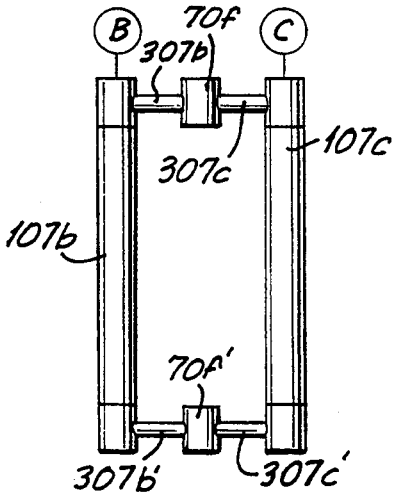

FIG. 3D shows the vertical framing along row BC. Perimeter member 307*b* is welded at one end to hollow vertical member 107*b* and at its other end to hollow vertical member 70*f*. Perimeter member 307*b'* is welded at one end to hollow vertical member 107*b* and at its other end to hollow vertical member 70*f'*. Perimeter member 307*c* is welded at one end to pile/conductor 107*c* and at its other end to hollow vertical member 70*f*. Perimeter member 307*c'* is welded at one end to pile/-conductor 107*c* and at its other end to hollow vertical member 70*f'*.

Hollow vertical members 70*f* and 70*f'* may be of a diameter which is less than hollow vertical member 107*b* and 107*c* and 36 inches is an appropriate diameter. It is preferred that hollow vertical members 70*f* and 70*f'* be of a thickness which is greater than the mid-section of hollow vertical members 107*b* and 107*c* but less than the ends of hollow vertical members 107*b–c* and 1 inch is an appropriate thickness.

The above module may be of a size other than 28 ft. The members of the module may be welded and constructed in other ways without departing from the spirit of the present invention, as will be recognized by those skilled in the art.

The brace and support structure 4 now will be described in detail with reference to FIGS. 4A–D.

Figure 4A:
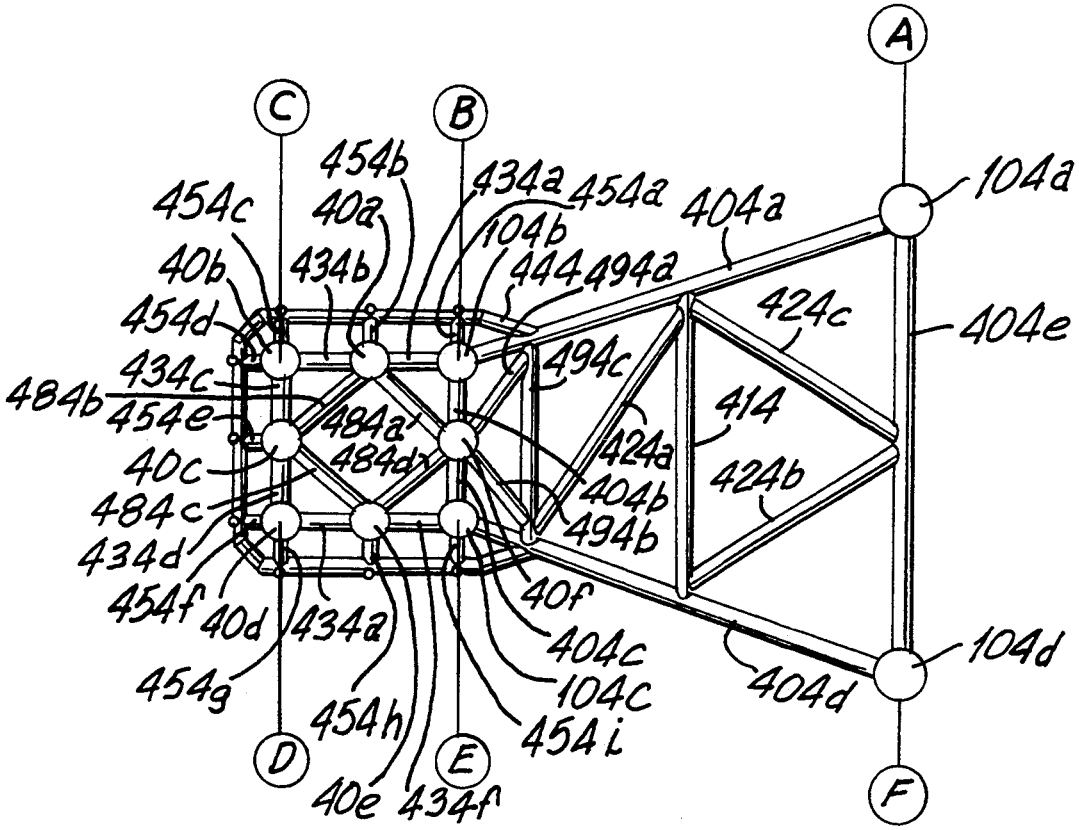
FIGS. 4A–D are plans and elevations at various sections of framing of the brace and support structure shown in FIGS. 1A and 1B.

FIG. 4A is a plan of the top horizontal framing of the brace and support structure 4. Much of the top horizontal framing for the brace and support structure 4 is the same as the top horizontal framing for the 12 ft. modular unit 8. Members 404*a–e* correspond to members 208*a–e*. Member 414 corresponds to member 218. Members 434*a–f* correspond to members 238*a–f*. Members 484*a–d* correspond to members 288*a–d*. Members 424*b–c* correspond to members 228*b–c*. Members 104*a–d* correspond to members 108*a–d*. However, diagonal member 424*a*, unlike, diagonal member 228*a*, does not connect to a hollow vertical member. Diagonal member 424*a* connects at one end near the top of center member 414, and at its other end near the bottom of internal member 494*c*.

Internal member 494*c* connects at one end near the bottom of perimeter member 404*a*, and at its other end near the bottom of perimeter member 404*d*. Internal member 494*a* connects at one end near the top of internal member 494*c*, and at its other end to hollow tube 40*f*. Internal member 494*b* connects at one end near the bottom of internal member 494*c*, and at its other end to hollow vertical member 40*f*.

Protruding members 454*a–i* are welded to hollow vertical members and extend outward from the brace and support structure 4. A fringe member 444, which may be one piece or composed of several sections, is welded to these protruding members and to the perimeter members 404*a* and 404*d*.

Figure 4B:
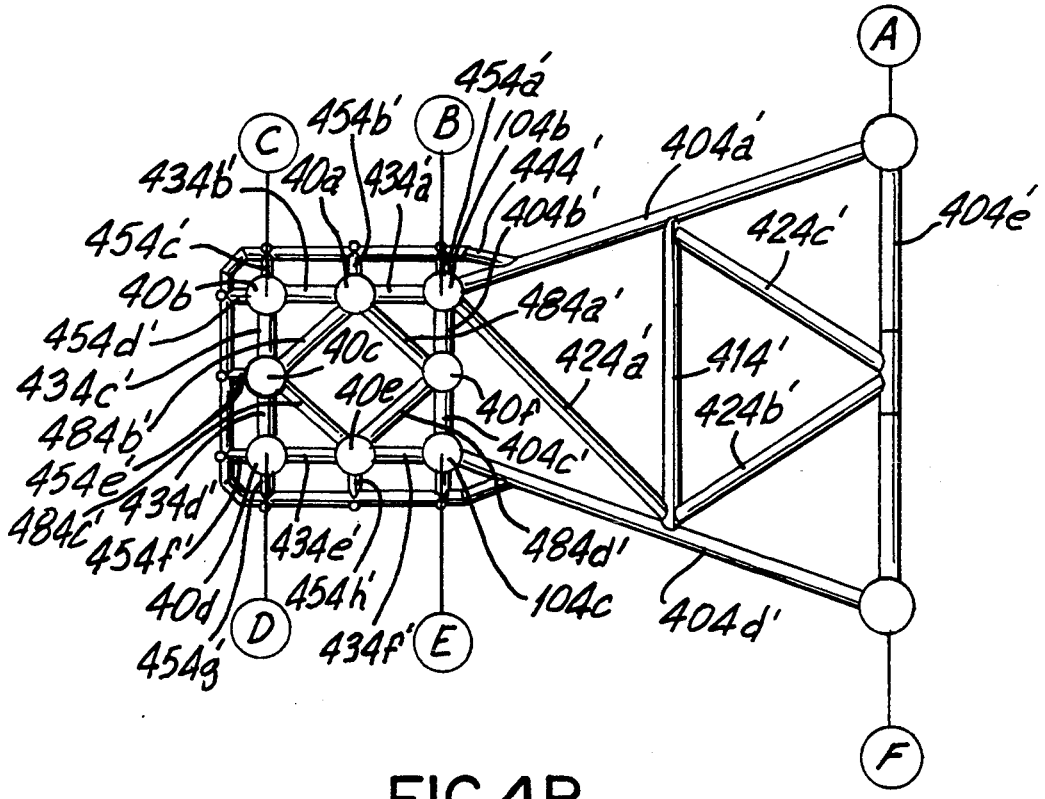

FIG. 4B is a plan of the bottom horizontal framing. The bottom horizontal framing is largely the same as the top. However, the bottom horizontal framing has no counterparts for internal members 494*a–c* of the top horizontal framing. In addition, the bottom horizontal framing differs from the top in that the diagonal member 424*a'* of the bottom horizontal framing is welded at one end near the bottom of center member 414', and at its other end to hollow vertical member 104*b*. Also members 404*a'* and 404*d'* are not parallel to members 404*a* and 404*d*, but rather are inclined upwards from their connections from one hollow vertical member to another hollow vertical member.

Figure 4D:
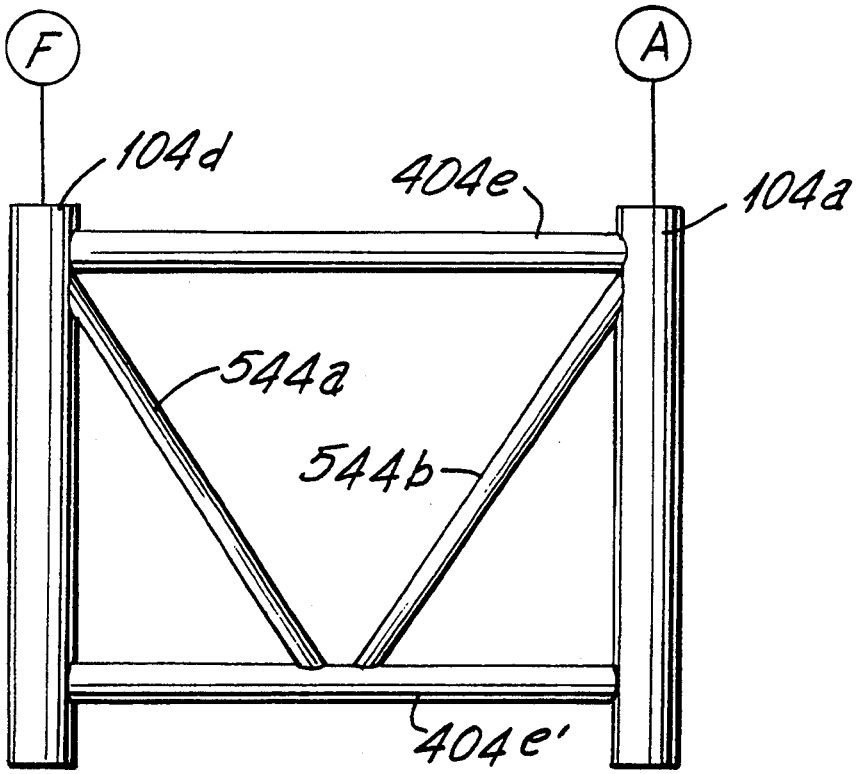
Figure 4C:
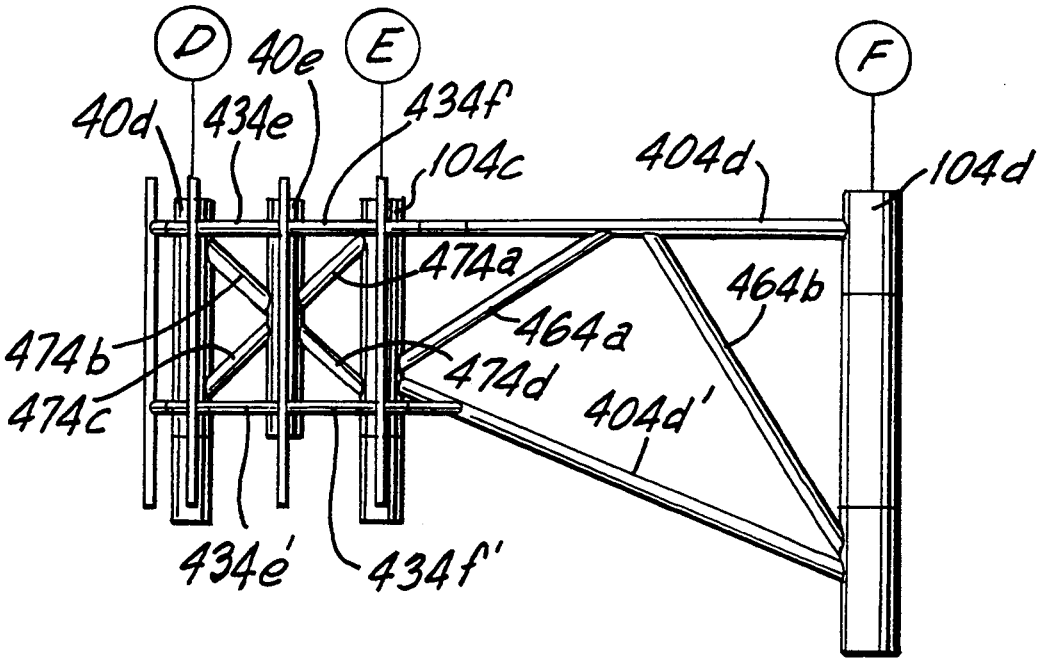

FIG. 4C shows the vertical framing of the brace and support structure 4 along row DF. Perimeter member 404*d* is welded at one end to hollow vertical member 104*c*, and at its other end to hollow vertical member 104*d*. Diagonal member 464*a* is welded at one end near the bottom of hollow vertical member 104*c*, and at its other end near the middle of perimeter member 404*d*. Perimeter member 404*d'* is welded at one end near the bottom of hollow vertical member 104*c*, and at its other end near the bottom of hollow vertical member 104*d*. Diagonal member 464*b* is welded at one end near the bottom of hollow vertical member 104*d*, and at its other end near the middle of perimeter member 404*d*. Perimeter member 434*f* is welded at one end to hollow vertical member 104*c*, and at its other end to hollow vertical member 40*e*. Perimeter member 434*e* is welded at one end to hollow vertical member 40*e*, and at its other end to hollow vertical member 40*d*. Perimeter members 434*e'* and 434*f'* are welded in a like manner at the bottom of the framing. Diagonal members 474*a–d* are welded near the middle of hollow vertical member 40*e* at one end and to hollow vertical member 40*d* or hollow vertical member 104*c* at their other ends.

The vertical framing along row AC is opposite that along row DF. The vertical framing along row BE and CD is the same as that along row DE except the various hollow vertical members may be of different diameters and thicknesses.

FIG. 4D shows the vertical framing along row FA. Perimeter member 404*e* is welded at one end to hollow vertical member 104*a* and at its other end to hollow vertical member 104*d*. Perimeter member 404*e'* is welded in the same manner at the bottom of the framing. Diagonal member 544*a* is welded at one end near the top of hollow vertical member 104*d*, and at its other end near the center of perimeter member 404*e'*. Diagonal member 544*b* is welded at one end near the top of hollow vertical member 104*a*, and at its other end near the center of perimeter member 404*e'*.

All of the piles, pile/conductors, conductors, and members of the various modules are made of steel. Two grades of steel are used in one embodiment, API-5L-X52 for the structural tubulars of the jacket assembly modules, piles and pile/conductors, and API-2H-50 for the balance of the structure.

Although the 12 ft. and 28 ft. modular units have been described as being welded together and then dropped onto the seafloor, the modules could be provided with a mechanical latch mechanism or some other form of connection and stacked on top of one another on the sea bed.

The present invention provides a simple modular construction method for an offshore platform jacket assembly of 160 feet or less. The invention is not limited to the drawings described. The offshore platform jacket assembly according to the present invention can be composed of any number of modules. It is preferred that the modules be of two types, such as modular unit 7 and modular unit 8 in the example in FIGS. 1A and 1B. The modular units 7 and 8 in FIGS. 1A and 1B are shown as 28 feet and 12 feet in length respectively. However, modules of other sizes may be constructed.

The jacket assembly configuration shown in FIGS. 1A and 1B is for water depths of 65 to 95 feet. Shown in FIGS. 5A–D are jacket assembly configurations for other various water depths. Each jacket assembly configuration is constructed in a similar manner as the jacket assembly construction of FIG. 1A and 1B. The jacket assembly configurations in FIGS. 5B–D all have at least one 12 ft. modular unit and at least one 28 ft. modular unit. The jacket assembly configuration of FIG. 5B is designed for water depths of 45 feet to 65 feet and is comprised of one ft. module and one 28 ft. module. The Jacket assembly configuration of FIG. 5C is comprised of two 12 ft. modules and three 28 ft. modules and is designed for water depths of 125 feet to 160 feet. The jacket assembly configuration of FIG. 5D is comprised of two 12 ft. modules and two 28 ft. modules and is designed for water depths of 95 feet to 125 feet.

Figure 5A:
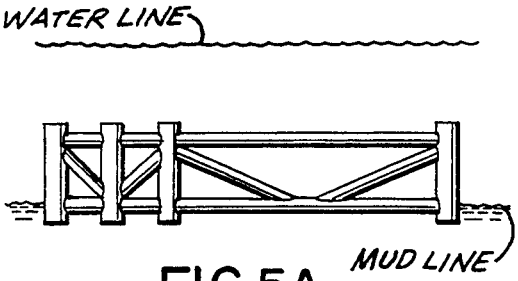
FIGS. 5A–D are perspective views of various configurations of modules constructed in accordance with the present invention.
Figure 5B:
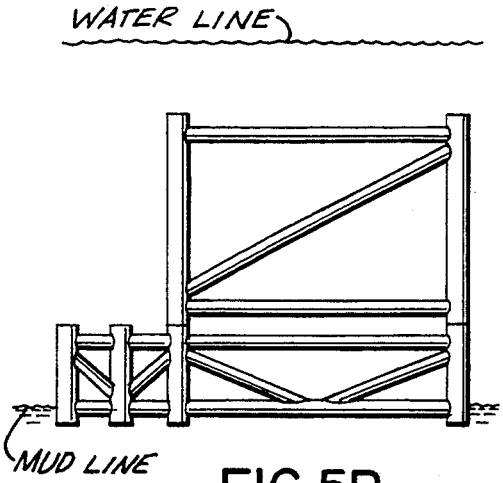
Figure 5C:
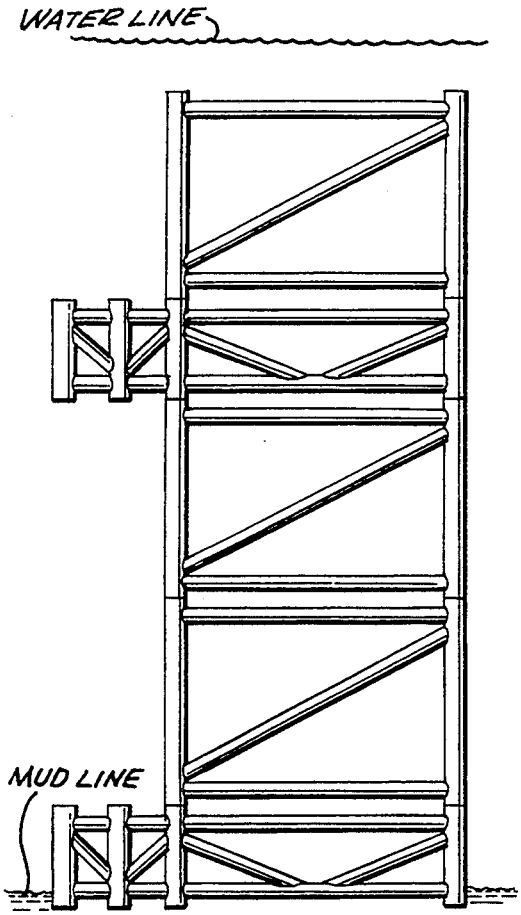
Figure 5D:
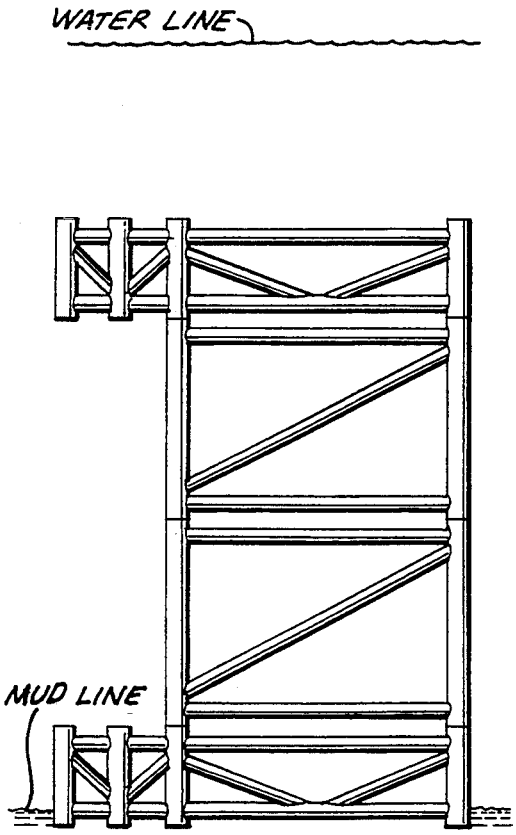

The jacket assembly configuration of FIG. 5A is unique in that it does not include a 12 ft. module or a 28 ft. module. This jacket assembly is designed for water depths of 20 to 45 feet and is comprised of one 3 ft. module. However, the three foot module is constructed in the same manner as a 12 ft. module.

The modules may be constructed differently and combined differently without departing from the spirit of the present invention. The brace and support structure may be of various sizes. The members of the brace and support structure may be welded and constructed in ways which do not depart from the present invention.

I claim:

1. A plurality of stackable modules adapted to be stacked on one another, for forming at least a portion of a jacket assembly for an offshore platform, said assembly adapted to be placed at least partially underwater to support said platform, each of said stackable modules comprising a plurality of rigid members joined so as to form a substantially rigid structure, said stackable modules adapted to be substantially interchangeable with each other so that the same stackable modules can be stacked in different sequences wherein said rigid members are joined together to form top horizontal framing, bottom horizontal framing and vertical framing, said vertical framing joining the top horizontal framing with the bottom horizontal framing, and wherein the plan at the top and bottom horizontal framing has a truncated triangular shape, having a major side at its base and a minor side formed at the truncation.

2. The stackable modules of claim 1 wherein each module includes one substantially vertical hollow rigid member which is designed for the passage of piles that function as conductors of fluids or gasses.

3. The stackable modules of claim 1 wherein each module includes two substantially vertical hollow rigid members, at least one of which is designed to permit the passage of a pile that does function as a conductor of fluids or gasses and at least one of which is designed to permit the passage of a pile that does not function as a conductor of fluids or gasses.

4. The stackable modules of claim 3 wherein the substantially vertical hollow rigid members that permit the passage of piles which function as conductors, are smaller in diameter and thickness than the substantially vertical hollow rigid members that permit the passage of piles which do not function as conductors of fluids or gasses.

5. The stackable modules of claim 1 wherein each module comprises three completely vertical hollow rigid members which are parallel to one another and which are designed to permit the passage of piles, said three completely vertical hollow rigid members of one module designed to align with the corresponding three completely vertical hollow rigid members of modules above and below.

6. The stackable modules of claim 1 wherein each module includes four completely vertical hollow rigid members which are parallel to one another and which are designed to permit the passage of piles, said four completely vertical hollow rigid members of one module designed to align with the corresponding four completely vertical hollow rigid members of modules above and below and wherein the top vertices of said four completely vertical hollow rigid members define a truncated triangular shape and the bottom vertices of said members also define a truncated triangular shape.

7. A plurality of stackable modules for forming a jacket assembly for an offshore platform, said jacket assembly adapted to be placed at least partially underwater to support said platform, said modules comprising:

four substantially vertical rigid members joined by horizontal or diagonal members so as to form a rigid structure, said substantially vertical rigid members arranged such that their top vertices define a truncated triangular shape, and their bottom vertices define a truncated triangular shape, each truncated triangle having a major side at its base and a minor side formed at the truncation, when viewed from above or below, wherein the four substantially vertical rigid members which define the truncated triangular shape are hollow so that piles can pass through and be joined to said four substantially vertical rigid members.

8. The module of claim 7 and further comprising two further substantially vertical rigid members joined by horizontal or diagonal members to said rigid structure so that the top vertices of the six substantially vertical rigid members define a six sided figure and the bottom vertices of the six substantially vertical rigid members define a six sided figure, said six sided figures having the shape of rectangles attached to truncated triangles, with the rectangles and the truncated triangles having one side in common, wherein the two further substantially vertical rigid members are hollow so that conductors can pass through said two further substantially vertical rigid members.

9. A method of constructing a stackable module, a plurality of which are used substantially interchangeably in forming a jacket assembly for an offshore platform said assembly adapted to be placed at least partially underwater to support said platform, comprising the steps of joining a plurality of rigid members to form a substantially rigid stackable module, a plurality of which modules are used substantially interchangeably with each other so that the same stackable modules can be stacked in different sequences wherein the plurality of rigid members are joined so that said rigid members form top horizontal framing, bottom horizontal framing and vertical framing, the vertical framing joining the top horizontal framing with the bottom horizontal framing, wherein the top and bottom horizontal framing are constructed so that each section of framing has a truncated triangular shape, having a major side at its base and a minor side formed at the truncation.

10. The method of claim 9 wherein two of the rigid members are hollow, positioned in a substantially vertical direction, and adapted to allow the passage of a pile which is not a conductor of fluids or gasses, and two of the rigid members are hollow, positioned in a substantially vertical direction, and adapted to allow the passage of a pile which is also a conductor of fluids or gasses.

11. The method of claim 10 and wherein the substantially vertical hollow members which are adapted to allow the passage of a pile which is not a conductor, are adapted to be of a larger diameter and a greater thickness than the substantially vertical hollow members which are adapted to allow the passage of a pile which is a conductor.

12. The method of claim 11 and wherein the substantially vertical hollow members which are adapted to allow the passage of a pile which is not a conductor, are placed so that their vertices define the major side at the base of a truncated triangle and wherein the substantially vertical members which are adapted to allow the passage of a pile which is a conductor, are placed so that their vertices define the minor side of the truncated triangle.

13. A method for constructing an offshore platform comprising the steps of:

stacking a plurality of modules on top of one another, each of said modules comprising a plurality of rigid members joined together, each module having first, second, third, and fourth substantially vertical hollow rigid members which are arranged to align with corresponding first, second, third, and fourth substantially vertical hollow rigid members of the modules above and below, joining said modules together to form a jacket assembly, driving first, second, third, and fourth piles through corresponding first, second, third, and fourth substantially vertical hollow rigid members of said modules, joining said first, second, third, and fourth piles to said first, second, third, and fourth substantially vertical hollow rigid members of said modules, installing first and second wellheads at the top of said third and fourth piles.

14. The method of claim 13 and wherein the first, second, third, and fourth substantially vertical hollow rigid members are arranged so that their top vertices define a truncated triangular shape, the top vertices of the first and second substantially vertical hollow rigid members forming the major side of the truncated triangle and the top vertices of the third and fourth substantially vertical hollow rigid members forming the minor side of the truncated triangle.

15. The method of claim 14 and wherein at least one of said modules is adapted to have fifth and sixth substantially vertical hollow rigid members, and further comprising the steps of:

passing first and second conductors through corresponding fifth and sixth substantially vertical hollow rigid members, installing third and fourth wellheads at the top of said first and second conductors, and wherein the fifth and sixth substantially vertical hollow rigid members are arranged so that their top vertices together with the top vertices of said third and fourth substantially vertical hollow rigid members define a rectangular shape.

16. An offshore platform comprising:

a jacket assembly having first, second, third, fourth, fifth, and sixth substantially vertical hollow rigid members, first and second piles passing through and joined to the first and second substantially vertical hollow rigid members of the jacket assembly to provide structural support for the jacket assembly, third and fourth piles passing through and joined to the third and fourth substantially vertical hollow rigid members of the jacket assembly to provide structural support for the jacket assembly, first and second wellheads installed at the top of said third and fourth piles, first and second conductors passing through the fifth and sixth substantially vertical hollow rigid members, third and fourth wellheads installed at the top of said first and second conductors, wherein the first, second, third, and fourth piles have top vertices which define a truncated triangular shape, the top vertices of the first and second piles forming the major side of the truncated triangle, the top vertices of the third and fourth piles forming the minor side of the truncated triangle, and the first and second conductors have top vertices which together with the top vertices of said third and fourth piles define a rectangular shape.

17. An offshore platform comprising:

modules of a first type and modules of a second type which are stacked one on top of the other, the first type of module having first, second, third and fourth vertical rigid members which are parallel to one another and joined together by other rigid members, the top vertices and bottom vertices of the first and second vertical rigid members forming the major side of a truncated triangle and the top vertices and bottom vertices of the third and fourth vertical rigid members forming the minor side of said truncated triangle, the second type of module having corresponding first, second, third and fourth vertical rigid members and fifth and sixth vertical rigid members which are parallel to one another and joined together by other rigid members, the top vertices and bottom vertices of the first and second vertical rigid members forming the major side of a truncated triangle, the top vertices and bottom vertices of the third and fourth vertical rigid members forming the minor side of said truncated triangle, the top vertices and bottom vertices of the fifth and sixth vertical rigid members forming one side of a rectangular shape where the opposite side of the rectangular shape is formed by the minor side of the truncated triangle.

18. The offshore platform of claim 17 wherein the vertical rigid members comprising the first type of module and the vertical rigid members comprising the second type of module are hollow, and the offshore platform further comprises:

first, second, third, and fourth piles which pass through corresponding first, second, third, and fourth vertical members of the stacked first and second type of modules, wherein said piles are joined to the vertical members they pass through, first and second conductors which pass through the fifth and sixth vertical rigid members of the second type of module, and first and second wellheads installed at the top of said first and second conductors.

19. The offshore platform of claim 18 and further comprising third and fourth well heads installed at the top of said third and fourth piles.

* * * * *

UNITED STATES PATENT AND TRADEMARK OFFICE

CERTIFICATE OF CORRECTION

PATENT NO. : 5,356,239

DATED : October 18, 1994

INVENTOR(S) : Canton

It is certified that error appears in the above-identified patent and that said Letters Patent is hereby corrected as shown below:

Column 1, line 9, before "present", insert -- The --.

Column 2, line 38, "Jacket" should be -- jacket --.

Column 4, line 28, "men%bets" should be -- members --.

Column 7, line 7, "238f" should be -- 238f' --.

Column 7, line 23, after "member", insert -- 80c --.

Column 9, line 46, "70f" should be -- 70f' --.

Column 9, line 47, the second "70f" should be -- 70f' --.

Column 9, line 50, second "70f" should be -- 70f' --.

Column 10, line 54, change "434f" to -- 434f' --.

Column 11, line 40, after "one", insert -- 12 --.

Column 11, line 41, "Jacket" should be -- jacket --.

Signed and Sealed this

Thirtieth Day of May, 1995

*Attest:*

Bruce Lehman

BRUCE LEHMAN

*Attesting Officer*

*Commissioner of Patents and Trademarks*